US010253434B2

(12) United States Patent
Nakamura et al.

(10) Patent No.: US 10,253,434 B2
(45) Date of Patent: Apr. 9, 2019

(54) POLYESTER BINDER FIBERS

(71) Applicant: KURARAY CO., LTD., Kurashiki-shi (JP)

(72) Inventors: Takashi Nakamura, Kurashiki (JP); Yoshinobu Oomae, Kurashiki (JP)

(73) Assignee: KURARAY CO., LTD., Kurashiki-shi (JP)

( * ) Notice: Subject to any disclaimer, the term of this patent is extended or adjusted under 35 U.S.C. 154(b) by 0 days.

(21) Appl. No.: 15/277,087

(22) Filed: Sep. 27, 2016

(65) Prior Publication Data

US 2017/0016149 A1 Jan. 19, 2017

Related U.S. Application Data

(63) Continuation of application No. PCT/JP2015/059748, filed on Mar. 27, 2015.

(30) Foreign Application Priority Data

Mar. 31, 2014 (JP) ..... 2014-073316

(51) Int. Cl.

| | |
|---|---|
| ***D01F 1/10*** | (2006.01) |
| ***D01F 6/92*** | (2006.01) |
| ***D21H 13/24*** | (2006.01) |
| ***D21H 21/18*** | (2006.01) |
| ***D21H 15/02*** | (2006.01) |

(52) U.S. Cl.

CPC ..... *D01F 6/92* (2013.01); *D21H 13/24* (2013.01); *D21H 15/02* (2013.01); *D21H 21/18* (2013.01); *D01F 1/10* (2013.01)

(58) Field of Classification Search

CPC .... D01F 6/92; D01F 1/10; D01F 6/62; D04H 1/435; D04H 3/011; D21H 13/24; D21H 15/02; D21H 21/18; Y10T 442/60

See application file for complete search history.

(56) References Cited

U.S. PATENT DOCUMENTS 4,609,710 A 9/1986 Iohara et al.
6,156,842 A * 12/2000 Hoenig ..... C08L 23/08 525/171
6,190,768 B1 * 2/2001 Turley ..... D01F 6/30 428/364
7,989,062 B2 * 8/2011 Chakravarty ..... A61F 13/15252 428/373
8,105,682 B2 * 1/2012 Sun ..... D01F 2/28 428/292.1
2004/0113309 A1 * 6/2004 Thompson, Jr. ..... D01D 5/0985 264/210.8
2004/0254286 A1 * 12/2004 Hansen ..... C08J 5/04 524/500
2006/0155064 A1 * 7/2006 Hansen ..... C08K 7/02 525/165
2010/0133173 A1 6/2010 Inagaki
2010/0136312 A1 6/2010 Inagaki
2011/0151738 A1 * 6/2011 Moore ..... D04H 1/4291 442/334
2012/0184166 A1 * 7/2012 Kurihara ..... D01F 6/625 442/181
2012/0315225 A1 * 12/2012 Porbeni ..... A61L 15/26 424/49
2014/0210141 A1 * 7/2014 Moore ..... D04H 1/4291 264/465
2017/0016149 A1 * 1/2017 Nakamura ..... D21H 13/24
(Continued)

FOREIGN PATENT DOCUMENTS

CN 101338023 A 1/2009
CN 101680184 A 3/2010
CN 101680185 A 3/2010
(Continued)

OTHER PUBLICATIONS

Machine Translation of JP 11-302923 A. (Year: 1999).*
(Continued)

*Primary Examiner* — Jose A Fortuna
(74) *Attorney, Agent, or Firm* — Oblon, McClelland, Maier & Neustadt, L.L.P.

(57) ABSTRACT

To provide a polyester binder fiber with improved adhesiveness and a fiber structure containing the polyester binder. (1) A polyester binder fiber includes a polyester and a polymer having a repeating unit represented by the following formula (1) in a proportion of 0.1 to 5.0 mass % based on the mass of the polyester, and the polyester binder fiber has a crystallization temperature measured by differential calorimetry in a range of 100 to 250° C.; (2) a fiber structure includes the polyester binder fibers, and polyester subject fibers without a crystallization temperature, the polyester subject fibers being bonded via the polyester binder fiber.

(1)

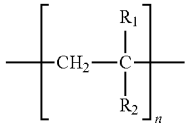

In the formula $R_1$ and $R_2$ are substituents each comprising arbitrary atoms chosen from C, H, N, O, S, P, and a halogen atom, the sum of the molecular weights of $R_1$ and $R_2$ is 40 or more, and n is a positive integer.

12 Claims, No Drawings

(56) References Cited

U.S. PATENT DOCUMENTS

2017/0204536 A1* 7/2017 Brunner ..... D01F 1/10

FOREIGN PATENT DOCUMENTS

| | | | | | |
|---|---|---|---|---|---|
| EP | 2080829 | A1 | * | 7/2009 | ..... B32B 5/022 |
| EP | 3128050 | A4 | * | 11/2017 | |
| JP | 63-32885 | | | 7/1988 | |
| JP | 63196751 | A | * | 8/1988 | |
| JP | 11-293522 | | | 10/1999 | |
| JP | 11-302923 | A | | 11/1999 | |
| JP | 3731788 | | | 1/2006 | |
| JP | 2006249137 | A | * | 9/2006 | |
| JP | 4031435 | | | 10/2007 | |
| JP | 2008-163484 | | | 7/2008 | |
| JP | 2008-169512 | | | 7/2008 | |
| JP | 2012-67408 | | | 4/2012 | |
| JP | 2012-67409 | | | 4/2012 | |
| JP | 2013-136851 | | | 7/2013 | |
| JP | 2013136851 | A | * | 7/2013 | |
| JP | 2013-174028 | | | 9/2013 | |
| WO | WO-2015152082 | A1 | * | 10/2015 | |

OTHER PUBLICATIONS

Machine Translation of JP 2008-163484 A. (Year: 2008).*
Machine Translation of JP 2012-167408 A. (Year: 2012).*
Machine Translation of JP 2013-174028 A. (Year: 2013).*
Extended Search Report dated Oct. 5, 2017 in European Patent Application No. 15773928.5.
Combined Chinese Office Action and Search Report dated Jun. 30, 2017 in Patent Application No. 201580017485.8 (with English Translation of Search Report and English Translation of Category of Cited Documents).
International Search Report dated Jun. 23, 2015 in PCT/JP2015/059748, filed Mar. 27, 2015 ( with English Translation).
Office Action dated Feb. 27, 2018 in Chinese Patent Application No. 201580017485.8 (with English language translation).
Office Action dated Sep. 5, 2018, in Chinese Patent Application No. 201580017485.8.
Office Action dated Oct. 26, 2018, in Taiwan Patent Application No. 104110384.
Notification of Reasons for Refusal dated Dec. 11, 2018, in Japanese Patent Application No. 2016-511633.

* cited by examiner

POLYESTER BINDER FIBERS

CROSS REFERENCE TO THE RELATED APPLICATIONS

This application is a continuation application, under 35 U.S.C. § 111(a), of international application No. PCT/JP2015/059748, filed Mar. 27, 2015, which claims priority to Japanese patent application No. 2014-073316, filed Mar. 31, 2014, the entire disclosure of which is herein incorporated by reference as a part of this application.

FIELD OF THE INVENTION

The present invention relates to a polyester binder fiber being suitable for producing fiber structures, such as wet-laid nonwoven fabrics and papers. The polyester binder fiber is capable of binding drawn polyester fibers (polyester subject fibers) to produce the fiber structures.

BACKGROUND OF THE INVENTION

Conventionally, synthetic fibers such as polyethylene fibers and polyvinyl alcohol fibers are used as binder fibers for papermaking. Recently, papers made of polyester fibers in part or all as raw materials have been more commonly used because the polyester fibers have excellent physical properties such as mechanical property, electrical property, heat resistance, dimensional stability, and hydrophobicity, as well as cost advantage. Further, with expand in amounts employed and use application of the polyester fibers, there is a demand for binder fibers to have improved adhesiveness so as to make it possible to produce a paper with high strength.

Patent Document 1 (JP Laid-open Patent Publication No. 2013-174028) discloses an undrawn polyester binder fiber for papermaking. In order to obtain a paper with high strength, the undrawn polyester binder fiber has an intrinsic viscosity of 0.50 to 0.60, a single fiber fineness of 1.0 to 2.0 dtex, and a fiber length of 3 to 15 mm, wherein a salt of alkyl phosphate is applied to the undrawn fiber in a proportion of 0.002 to 0.05% by mass. Patent Document 1 describes that production of a fiber having a single fiber fineness of less than 1.0 dtex causes frequent fiber breakage due to small tenacity of monofilament, resulting in deterioration in water dispersibility of the obtained fibers.

Patent Document 2 (Japan Patent No. 3731788) discloses a spinning technology, wherein a molten polyester including a polymer such as a polymethyl methacrylate in a proportion of 0.1 to 5% by weight is discharged from a spinneret having 1000 holes or more, in order to avoid, between the inner and outer perimeters of the yarn, variations in physical properties such as orientation and crystallinity, as well as in dye affinities, and further to prevent an out-of-order situation in the process due to fiber breakage. According to Patent Document 2, this technology does not require complicated equipment modification.

DISCLOSURE OF THE INVENTION

Patent Document 1 does not have an intention to reduce the single fiber fineness of the polyester binder fiber for papermaking because Patent Document 1 states that production of a fiber having a single fiber fineness of less than 1.0 dtex causes frequent fiber breakage because of small tenacity of monofilament, leading to deterioration in water dispersibility of the obtained fibers.

Although Patent Document 2 discloses that a polyester fiber free from dye spot with good handleability can be obtained by discharging a molten polymer blend of a polyester and a small amount of a polymer, such as a polymethyl methacrylate, from a spinneret having 1000 holes or more, and by drawing the discharged as-spun filaments. However, Patent Document 2 never teaches nor suggests the use application of the obtained polyester fiber to a binder fiber.

The single fiber fineness of the polyester binder fiber can be selected depending on the purpose of use; however, requirement of a binder fiber with higher adhesivity advantageously leads to production of a binder fiber with a single fiber fineness of smaller than 10 dtex in an as-spun (undrawn) state. If it is possible to propose a polyester binder fiber with high adhesivity satisfying requests from users, such a polyester binder fiber can contribute to production of a novel fiber structure with higher strength. Where such a novel fiber structure with high strength is used for a filter use, the fiber structure can be used under the environment with a pressure higher than before. Further, in the applications requiring fiber structures to have a certain strength, binder fibers with a higher tenacity can lead to production of a fiber structure, even with a reduced basis weight, that has the same strength with the conventional fiber structure, resulting in achievement in cost reduction. Accordingly, the present inventors started to study the present invention.

As a result of intensive studies conducted by the inventors of the present invention to achieve the above objects, the inventors of the present application has found the followings: where a polyester is blended with a polymer having a repeating unit represented by the following formula (1) disclosed in Patent Document 2 in a proportion of 0.1 to 5.0 mass % (based on the mass of polyester) to obtain a polymer blend, the polymer blend is advantageously used for spinning to obtain a fiber having a small fineness of less than 1 dtex even in an undrawn state, as well as to obtain a fiber having an excellent adhesiveness even with a fineness of 1 dtex or greater. Based on the above findings, the inventors reached to the present invention.

A first aspect of the present invention is a polyester binder fiber including a polyester and a polymer having a repeating unit represented by the following formula (1) in a proportion of 0.1 to 5.0 mass % based on the mass of the polyester, and the polyester binder fiber having a crystallization temperature measured by differential calorimetry in a range of 100° C. or higher and 250° C. or lower.

Chem. 1

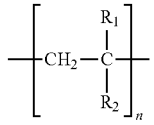

(1)

Where $R_1$ and $R_2$ are substituents each comprising arbitrary atoms chosen from C, H, N, O, S, P, and a halogen atom, the sum of the molecular weights of $R_1$ and $R_2$ is 40 or more, and n is a positive integer.

In the formula (1), $R_1$ and $R_2$, being independent from each other, may include an alkyl group with 1 to 10 carbon atoms, an alkoxy group with 1 to 10 carbon atoms, an aryl group with 6 to 20 carbon atoms which may have a substituent, a hydrogen atom, a halogen atom, a carboxylic acid group, a carboxylate group, a hydroxy group, a cyano group, a sulfonic acid group, a sulfonate group, an amide group, a sulfonamide group, a phosphonic acid group, a phosphonate group, or other groups.

The polyester binder fiber may be preferably an undrawn fiber.

The polyester binder fiber may be a polyester binder fiber in which the polymer having a repeating unit represented by the formula (1) is a polymethyl methacrylate (PMMA).

The polyester may comprise a polyethylene terephthalate. The intrinsic viscosity of the polyester may be from 0.4 to 1.1 dL/g.

The polyester binder fiber may have a single fiber fineness of 0.01 to 10 dtex.

The polyester binder fiber may have a fiber cross-sectional shape of circular, modified, hollow, or conjugated (composite). The polyester binder fiber may have a fiber length of 0.5 to 50 mm.

A second aspect of the present invention is a fiber structure including at least the above-mentioned polyester binder fibers and polyester subject fibers, in which each of the polyester subject fibers does not show a crystallization temperature; and the polyester subject fibers are bonded via the polyester binder fibers. The fiber structure may be a nonwoven fabric. The nonwoven fabric may be a wetlaid nonwoven fabric. The wetlaid nonwoven fabric may be a paper.

The present invention encompasses any combination of at least two features disclosed in the claims and/or the specification. In particular, the present invention encompasses any combination of at least two claims.

According to the first aspect, a polyester binder fiber can be obtained by spinning a polymer blend containing a polyester and a small amount of a polymer having a repeating unit represented by the formula (1). Spinnability of the polymer blend is so improved that a polyester binder fiber with a small fineness of 1 dtex or less can be obtained in an undrawn state. Further, thus obtained polyester binder fiber with the above-mentioned small fineness of 1 dtex or less as well as the polyester binder fiber with the fineness of larger than 1 dtex can yield an improved fiber structure, such as a wetlaid nonwoven fabric and a paper, wherein the polyester subject fibers in a drawn state are bonded by the polyester binder fibers with higher adhesiveness comparing with adhesiveness exhibited by a binder fiber without a polymer having a repeating unit represented by the formula (1).

According to the second aspect of the present invention, the fiber structure includes at least the polyester binder fibers (e.g., undrawn polyester binder fibers) and polyester subject fibers (e.g., drawn polyester fibers); and has a configuration in which the polyester subject fibers are bonded via the polyester binder fibers. Higher adhesivity of the polyester binder fibers to bind the polyester subject fiber enables to impart higher tensile strength (paper strength) to various fiber structures, such as a wetlaid nonwoven fabric and a paper. Preferably, the polyester included in the polyester binder fiber is the same species with the polyester included in the polyester subject fiber.

DESCRIPTION OF THE EMBODIMENTS

According to an embodiment of the present invention, the polyester binder fiber is obtained by spinning a polyester blend containing a polymer having a repeating unit represented by the formula (1) in a proportion of 0.1 to 5.0 mass % (based on the mass of a polyester).

Polyester

The polyester used in an embodiment of the present invention is a polyester having a fiber forming capability and containing an aromatic dicarboxylic acid as a main acid component. Examples of the polyester may include a polyethylene terephthalate, a polytetramethylene terephthalate, a to polycyelohexylenedimethylene terephthalate, and other polyesters. Moreover, these polyesters may be copolymers comprising another alcohol or another carboxylic acid (isophthalic acid etc.) to be copolymerized as a third component. Especially, polyethylene terephthalate is most preferable. From the viewpoint of spinnability of a polyester used and physical properties of obtained fibers, the polyester may have an intrinsic viscosity of preferably 0.4 to 1.1 dL/g, more preferably 0.4 to 1.0 dL/g, still more preferably 0.4 to 0.9 dL/g, and especially preferably 0.4 to 0.8 dL/g.

Polymer to be Blended with Polyester

According to an embodiment of the present invention, as the polymer to be blended with the polyester, there may be mentioned a polymer having a repeating unit represented by the formula (1), hereinafter sometimes referred to as a polymer (1). Where the sum of the molecular weights of $R_1$ and $R_2$ is 40 or more, the polymer (1) can impart an advantage to produced fibers to retain sufficient physical properties even at high temperatures. Where the sum of the molecular weights of $R_1$ and $R_2$ is less than 40, the advantage is hardly recognizable. Moreover, it is preferable that the sum of the molecular weights of $R_1$ and $R_2$ is 5000 or less. Such a polymer may be a polymer blend or copolymer, having a repeating unit represented by the formula (1).

In particular, as the polymer represented by the formula (1), there may be mentioned:

(a) a homopolymer or copolymer obtained from a (meth) acrylic monomer represented by the formula (2):

Chem. 2

(2)

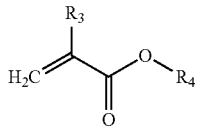

where $R_3$ represents a hydrogen atom or a methyl group, and $R_4$ represents a saturated hydrocarbon group with 1 to 10 carbon atoms, for example, a polymethyl methacrylate and the derivatives thereof, for example, a methyl methacrylate/alkyl acrylate copolymer, and an acrylic/styrene copolymer;

(b) a homopolymer or copolymer obtained from a styrenic monomer represented by the following formula (3):

Chem. 3

(3)

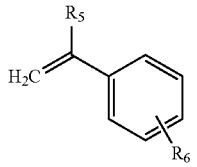

where $R_5$ represents a hydrogen atom or a methyl group, $R_6$ represents a hydrogen atom or a saturated or unsaturated chain hydrocarbon group with 1 to 12 carbon atoms, and $R_6$ may be same or different and bond at one or more places on the aromatic ring, for example, a polystyrene and the derivatives thereof, such as an alkyl- or aryl-substituted polystyrene, and a polyvinyl benzyl;

(c) a polyoctadecen; and other polymers.

As a comonomer copolymerizable with a monomer such as methyl methacrylate or styrene, any comonomer can be used as far as the comonomer does not cause disadvantageous effect on the polymethyl methacrylate or polystyrene. Among the above-mentioned polymers, particularly preferable one includes a polymethyl methacrylate and a polystyrene.

Arbitrary methods can be employed when adding, to a polyester, a polymer having the repeating unit of the formula (1). For example, the addition may be carried out during the polymerization process of a polyester. Alternatively, a polyester and a polymer (1) may be melt-kneaded, extruded, and to cooled, and then the cooled material may be cut into chips. Furthermore, after preparing polyester chips and polymer (1) chips, the chips can be mixed and be subjected to melt-spinning. Where kneading the polymers in molten state, it is preferable to use a screw-type melt extruder in order to enhance the degree of kneading. In any way, fully mixing or kneading procedure is important to render the added polymer finely and uniformly spread (dispersed) in the polyester.

The addition amount of the polymer having the repeating unit of the formula (1) in the present invention is required to be 0.1 to 5.0 mass % on the mass basis of polyester, preferably 0.15 to 5.0 mass %, more preferably 0.2 to 5.0 mass %, and still more preferably 0.3 to 5.0 mass %. Even if the polymer having the repeating unit of the formula (1) is added in a proportion of 0.1 to 5.0 mass %, the intrinsic viscosity value of the obtained polyester resin is hardly influenced. Where the addition amount is less than 0.1 mass %, the effect of the present invention is not observed. On the other hand, where the addition amount exceeds 5.0 mass %, the spinning process is poor at spinnability, resulting in frequent fiber breakages (spinning breaks) as well as deteriorated winding property, and therefore inadequate from the viewpoint of practical utility.

Single Fiber Fineness

The polyester blend containing a polymer having a repeating unit of the formula (1) in a proportion of 0.1 to 5.0 mass % can be subjected to the ordinary spinning method so as to obtain a polyester binder fiber in undrawn state. Blending the polymer having a repeating unit of the formula (1) renders the polyester blend to have more improved spinnability than the spinnability of the polyester without the polymer (1). Consequently, it is possible to produce an undrawn polyester fiber having a small fineness (for example, 0.01 to 1.0 dtex). Further, as shown in the below-mentioned Examples, it is possible to obtain an undrawn polyester binder fiber excellent in adhesiveness.

The single fiber fineness of the polyester binder fiber may be preferably 0.01 dtex or more and 10 dtex or less, more preferably 0.01 dtex or more and 5.0 dtex or less, still more preferably 0.01 dtex or more and 1.0 dtex or less, and particularly preferably 0.01 dtex or more and less than 1.0 dtex.

Here, for example, where a drylaid nonwoven fabric is produced using a carding machine etc.; if fibers with too small fineness are fed to the machine, fiber breakage may appear. For this reason, the undrawn polyester binder fiber for drylaid nonwoven fabrics may have a single fiber fineness of preferably 0.1 dtex or more and 10 dtex or less.

Alternatively, compared with producing the drylaid nonwoven fabric, producing wetlaid nonwoven fabrics (for example, a method of papermaking from a water dispersion of fibers) rarely causes fiber breakage because the process of producing the wetlaid nonwoven fabrics does not need to perform mechanical treatment of the fibers using a carding machine, etc. For this reason, the undrawn polyester binder fiber for wetlaid nonwoven fabrics may have a single fiber fineness of preferably 0.01 dtex or more and 10 dtex or less. Where the polyester binder fiber has a too large single fiber fineness, the weight per fiber will increase. Accordingly, for example, where a paper having a predetermined basis weight is produced, the number of binder fibers per unit area of paper may decrease, resulting in deteriorated binder effect of the binder fibers. As a result, the binder fibers may have unfavorably declined adhesiveness, or may cause difficulty in production of fiber structures, such as a wetlaid nonwoven fabric and a paper, with uniform bonding strength.

Alternatively, the undrawn polyester binder fiber for producing a woven or knitted fabric may have a single fiber fineness of preferably 0.1 dtex or more and 10 dtex or less.

Crystallization Temperature

According to an embodiment of the present invention, in order to function as a binder fiber, the polyester binder fiber is required to have a crystallization temperature measured in accordance with differential calorimetry. The polyester binder fiber exhibits adhesiveness during heating process heated at a temperature of crystallization temperature or higher and binds subject fibers, such as drawn polyester fibers, so as to give a fiber structure by functioning as a binder fiber. On the other hand, a polyester fiber without a crystallization temperature such as a drawn polyester fiber does not function as a binder fiber. Here, as for the fiber structure containing the binder fiber after adhesion, it is preferable that crystallization temperature of the fiber structure is not observed in accordance with differential calorimetry (differential thermal analysis).

The crystallization temperature of the undrawn polyester binder fiber is required to be 100° C. or higher and 250° C. or lower, preferably 105° C. or higher and 220° C. or lower, and more preferably 105° C. or higher and 200° C. or lower. There is a possibility that the binder fiber having a crystallization temperature of lower than 100° C. may crystallize during drying procedure so that a desired paper strength may not be achieved. Moreover, there is a possibility that the undrawn polyester binder fiber may fail to exhibit crystallization temperature due to the heat at the time of handling of the polyester binder fiber. Where the crystallization temperature exceeds 250° C., there is a small difference in temperature between the melting point of the polyester subject fiber and the crystallization temperature of the polyester binder fiber, resulting in difficulty in temperature control during the heating process. Further, since the temperature at which the polyester binder fiber exhibits adhesiveness also causes fusion of the polyester subject fiber, production of a fiber structure may be disadvantageously performed.

The crystallization temperature can be controlled by changing chip viscosity (intrinsic viscosity), single fiber fineness, and temperature conditions for spinning. For example, crystallization temperature can be raised by lowering chip viscosity (lowering polymerization degree), raising spinning temperature, or enlarging single fiber fineness. Moreover, crystallization temperature can be lowered by raising chip viscosity (raising polymerization degree), lowering spinning temperature, or reducing single fiber fineness.

Cross-Sectional Shape of Fiber

According to the present invention, spinning for producing the polyester binder fiber may be performed using an ordinal circular nozzle, or using a nozzle for producing a fiber with modified cross-sectional shape, a composite fiber (sheath core composite fiber etc.), or a hollow-fiber.

Fiber Length

Moreover, the polyester binder fiber according to the present invention may have a fiber length of preferably 0.5 to 50 mm, more preferably 1 to 25 mm, and still more preferably 2 to 15 mm. For example, where producing a paper, an embodiment of a wetlaid nonwoven fabric, a binder fiber with a fiber length of less than 0.5 mm may have difficulty in exhibiting sufficient paper strength because the number of the subject fibers to be connected by one binder fiber is decreased. On the other hand, where using a binder fiber with a fiber length of over 50 mm, such binder fibers will be entangled with each other during the papermaking so that the entangled portion will appear as a defect portion of the paper. Further, some of the binder fibers gather in such a defect portion, resulting in causing troubles in production process as well as lowering paper strength. Moreover, in the process for producing the drylaid nonwoven fabric using a carding machine or others, it is necessary for a web comprising fibers to move down a line continuously without a break in the travelling direction. For this reason, the fiber length desirable in manufacture of drylaid nonwoven fabrics is preferably 10 to 50 mm, more preferably 15 to 50 mm, and still more preferably 20 to 50 mm.

In addition, an additional fiber (for example, a polyester fiber which does not have crystallization temperature), and a binder fiber may be mix-spun for producing a woven or knitted fabric, and then the woven or knitted fabric may be heated to produce a fabric having bonded portion formed by melting of the binder fiber. The fiber length of the binder fiber for the woven or knitted fabric may be preferably in a range of 0.5 to 50 mm.

Additives

According to the present invention, the polyester binder fiber, if necessary, may comprise a grinding agent, a heat stabilizer, an ultraviolet radiation absorbent, an antistatic agent, a terminating agent, and a fluorescent brightener, and/or other additives.

Fiber Structure

The polyester binder fiber (hereinafter may be simply referred to as a binder fiber) according to the present invention can be used as a binder fiber for drylaid nonwoven fabric, and blended with a subject fiber comprising a drawn polyester fiber so as to produce a drylaid nonwoven fabric. Alternatively, the binder fiber can also exhibit a binder function in a woven or knitted fabric and/or quilting. In order for the binder fiber to exhibit a binder function in the production of a drylaid nonwoven fabric, the binder fiber may be preferably blended in a proportion of 5 to 95 mass % relative to subject fiber.

Furthermore, the binder fiber may be cut into 2 to 15 mm in length and mixed with a drawn polyester fiber, in addition, a pulp and/or other subject fiber for papermaking, and used for producing a wetlaid nonwoven fabric by exhibiting a binder function. By using the polyester binder fiber according to the present invention, various kinds of fiber structure can be produced. Among them, the wetlaid nonwoven fabric is the most preferable embodiment, and will be described in detail.

Here, a drylaid nonwoven fabric can be obtained by forming a web (using a carding machine etc.) without water and heating the web so that the fibers in the web can be bonded with binder fibers. Alternatively, a wetlaid nonwoven fabric can be obtained by forming a web (for example, with water in the process), if necessary drying the web, and heating the web so that the fibers in the web can be bonded with binder fibers. As the concrete method of forming a web in the process using water, there may be mentioned a papermaking method that comprises dispersing fibers in water to produce a paper-like web, a hydroentangling method that comprises forming a web without water and entangling fibers in the web using water, and other methods.

Papermaking

The polyester binder fibers according to the present invention may be mixed with subject fibers such as drawn polyester fibers, so as to produce a wetlaid nonwoven fabric such as a paper by papermaking. The polyester binder fiber for papermaking may be cut, after spinning, into 0.5 to 50 mm preferably 2 to 15 mm in cut length, and then fed into a papermaking machine. The binder fiber having too short cut length has a tendency that the binder fiber is insufficient in respect of the adhesiveness for binding subject fibers. The binder fiber having too long cut length has a tendency that the binder fibers are easily entangled so as to have declined water dispersibility.

The polyester subject fibers such as polyester drawn fibers may contain a polyester polymer as a principal component alike as the polyester polymer contained in the undrawn polyester binder fiber. It should be noted that the polyester subject fibers such as polyester drawn fibers does not usually include the polymer represented by the formula (1). The fineness of the polyester subject fiber such as a polyester drawn fiber may be preferably 0.01 dtex or more and 20 dtex or less, more preferably 0.01 dtex or more and 15 dtex or less, and still more preferably 0.01 dtex or more and 10 dtex or less. The subject fibers each having a fineness exceeding the upper limit may decline the number of fibers constituting a paper, resulting in reduced paper strength. The subject fibers each having a fineness under the lower limit are easily entangled with each other during papermaking because of too small fineness, resulting in occurrence of fault portions that are disadvantageous for producing uniform paper.

In wetlaid nonwoven fabrics, the mass ratio (subject fiber/binder fiber) of the subject fiber (drawn polyester fiber) and the binder fiber may be 95/5 to 5/95, preferably 80/20 to 20/80, more preferably 75/25 to 25/75, still more preferably 70/30 to 30/70, and particularly preferably 70/30 to 50/50. Too small amount of the binder fiber renders the wetlaid nonwoven fabric to have too reduced bonding points between fibers, so that the wetlaid nonwoven fabric has a tendency of insufficient strength. On the other hand, too high amount of the binder fiber renders the wetlaid nonwoven fabric to have too much bonding points between fibers, so that the wetlaid nonwoven fabric becomes too stiff and therefore is not preferable.

According to the present invention, a fiber mixture of the binder fibers and the subject fibers is usually heat-treated in the pressing process, after papermaking, at a high temperature of 180° C. or higher and 250° C. or lower. The heat-treating period during the pressing process may be preferably 15 minutes or less, more preferably 12 minutes or less, and still more preferably 10 minutes or less. By adjusting the heat-treating period and temperature in the pressing process, the binder fiber having an amorphous part can be heated to a temperature of the crystallization temperature or higher and be crystallized in a state of binding subject fibers. Accordingly, the crystallization temperature of the binder fiber disappears so that higher paper strength can be achieved.

The papermaking method can be carried out by ordinal methods, using a cylinder-screen paper-making system, a short-screen paper-making method, and other method.

EXAMPLES

Hereinafter, the present invention will be demonstrated by way of some examples that are presented only for the sake of illustration, which are not to be construed as limiting the scope of the present invention. It should be noted that chip viscosity (intrinsic viscosity), single fiber fineness, spinnability, paper strength, paper thickness, and other properties according to the present invention were measured and/or evaluated in the following manners.

Chip Viscosity (Intrinsic Viscosity)

The chip viscosity (intrinsic viscosity) (dL/g) of a sample was measured using an Ubbelohde viscometer ("HRK-3", produced by Hayashi Seisakusho Co.) corresponding to JIS K 7367-1. The solvent used for measurement was a mixed solvent of phenol/tetrachloroethane (volume ratio of 1/1) at 30° C.

Cross-Sectional Shape

After spinning to obtain a wound fiber, the fiber was cut using a razor in the perpendicular direction to the longitudinal direction of the fiber. The cross-sectional shape of the fiber after cutting was observed using a micro scope (VHX-5000) produced by KEYENCE CORPORATION.

Single Fiber Fineness

The single fiber fineness (dtex) was determined according to JIS L1015 "the chemical fiber staple examination method (8.5.1)".

Crystallization Temperature

The Crystallization temperature of a sample was measured in accordance with a method described in JIS K 7121-1987 using a thermogravimetry and differential thermal analyzer "Thermoplus TG8120" produced by Rigaku Corporation.

Spinnability

The spinnability of a sample was evaluated in accordance with the following criteria:

A: Winding can be carried out without any trouble, such as a spinning break.

B: Winding can be carried out at a predetermined winding speed although spinning breaks occur sometimes.

C: Winding cannot be carried out at a predetermined winding speed.

Paper Strength (Tensile Strength)

The paper strength (tensile strength) (kg/15 mm) was measured by an examining method according to JIS P 8113. It should be noted that a paper strength (tensile strength) value (kg/15 mm) be converted into a value "kN/m" from the following formula.

$$\text{"Value" (kN/m)} = \text{"Value" (kg/15 mm)} \times 66.7 \times (1000/15)/9.8$$

Paper Thickness

The paper thickness (mm) was measured by an examining method according to the JIS P 8118.

Evaluation in Water Immersion

A sample of the obtained paper was immersed in 25° C. in water for 1 hour, and determined appearance change of the paper sample. The results were described in Table 1.

A: With no change on appearance.

B: With change such as tearing.

Examples 1 to 7 and Comparative Examples 1 to 4

Polyester Binder Fiber

After drying polyethylene terephthalate chips (polyester chip produced by Kuraray Co., Ltd.) in an ordinal method, polymer chips of polymethyl methacrylate, hereafter may be simply abbreviated as PMMA, ("PARAPET" (registered trademark) HR-100L produced by Kuraray Co., Ltd.) were mixed to the polyethylene terephthalate chips by changing mixing ratios. The mixtures rendered to be melted at 300° C. so that the PMMA was uniformly spread in the polyethylene terephthalate. The PMMA blend ratios and chip viscosities of Examples and Comparative Examples were shown in Table 1. Subsequently, the molten polymer blend was metered using a gear pump, and discharged at a predetermined amount from a spinning nozzle (hole size=ϕ0.16; number of holes=1880) (nozzle temperature: 300° C.), and the discharged filaments were wound up at a winding speed of 1400 m/min. to produce undrawn polyester fibers each having a crystallization temperature of 120 to 132° C. measured using the above-described thermogravimetric-differential thermal analyzer. In each of Comparative Examples 1 to 3, the spinning was performed without blending PMMA. The spinnability, the cross-sectional shape, and the single fiber fineness of the obtained fibers were shown in Table 1.

Papermaking

The binder fibers each cut into 5 mm in length and polyester subject fibers ("EP-053" produced by Kuraray Co., Ltd.; single fiber fineness: 0.8 dtex, cut length: 5 mm) were fed to a disintegrator (produced by TESTER SANGYO CO., LTD.) in the ratio of the binder fiber to the subject fiber (binder fiber: subject fiber)=40:60. After disintegration of fibers at 3000 rpm for 1 minute, papermaking was carried out using a TAPPI-papermaking machine (produced by KUMAGAI RIKI KOGYO Co., Ltd.) in Examples and Comparative Examples each containing binder fibers shown in Table below so as to obtain a web having a basis weight of 60 g/m$^2$. Then, the obtained web was pressed for 30 seconds under a pressure of 3.5 kg/cm$^2$ using a pressing machine (produced by KUMAGAI RIKI KOGYO Co., Ltd.) for moisture adjustment, and dried at 120° C. for 1 minute using a rotary dryer (produced by KUMAGAI RIKI KOGYO Co., Ltd.) to obtain a paper-type wetlaid nonwoven fabric. Subsequently, the wetlaid nonwoven fabric was heat-treated for 3 seconds through a heat press roller (220° C., crevice: 0.1 mm) to obtain a paper (15 mm×100 mm strip) in which crystallization temperature disappeared.

The papers obtained in Examples and Comparative Examples were subject to measurement of basis weight, paper thickness, and paper strength, and the obtained results were shown in Table 1.

TABLE 1

| | Binder fiber | | | | | | |
|---|---|---|---|---|---|---|---|
| | PMMA content (mass %) | PET intrinsic viscosity [η] (dL/g) | Cross-sectional Shape | Single fiber fineness (dtex) | Crystallization temperature (° C.) | Spinnability | Subject fiber Fineness (dtex) |
| Ex. 1 | 1.0 | 0.575 | Circular | 0.8 | 120.0 | A | 0.8 |
| Ex. 2 | 1.0 | 0.575 | Circular | 1.0 | 123.0 | A | 0.8 |
| Ex. 3 | 1.0 | 0.575 | Circular | 1.5 | 127.0 | A | 0.8 |
| Ex. 4 | 1.0 | 0.575 | Circular | 5.0 | 132.0 | A | 0.8 |
| Ex. 5 | 5.0 | 0.575 | Circular | 1.5 | 127.0 | B | 0.8 |
| Ex. 6 | 0.1 | 0.575 | Circular | 1.5 | 127.0 | A | 0.8 |
| Ex. 7 | 1.0 | 0.575 | Hollow | 2.2 | 128.0 | A | 0.8 |
| Com. Ex. 1 | 0.0 | 0.575 | Circular | 0.8 | — | C | — |
| Com. Ex. 2 | 0.0 | 0.575 | Circular | 1.0 | 123.0 | A | 0.8 |
| Com. Ex. 3 | 0.0 | 0.575 | Circular | 1.5 | 127.0 | A | 0.8 |
| Com. Ex. 4 | 7.0 | 0.575 | Circular | 1.5 | — | C | — |

| | Evaluation of obtained paper | | | | | | | | | |
|---|---|---|---|---|---|---|---|---|---|---|
| | Blend ratio in paper (%) | | Heat-pressing | Basis weight ($g/m^2$) | | Paper | Paper strength (Tensile strength) | | Evaluation | |
| | Binder fiber | Subject fiber | temperature (° C.) | Raw paper | Heat-pressed paper | thickness (mm) | (kg/15 mm) | (kN/m) | in water immersion | Remarks |
| Ex. 1 | 40 | 60 | 220 | 60 | 85 | 0.198 | 3.72 | 0.380 | A | |
| Ex. 2 | 40 | 60 | 220 | 60 | 87 | 0.202 | 3.43 | 0.350 | A | |
| Ex. 3 | 40 | 60 | 220 | 60 | 85 | 0.206 | 3.10 | 0.316 | A | |
| Ex. 4 | 40 | 60 | 220 | 60 | 86 | 0.211 | 2.90 | 0.296 | A | |
| Ex. 5 | 40 | 60 | 220 | 60 | 88 | 0.207 | 3.68 | 0.376 | A | |
| Ex. 6 | 40 | 60 | 220 | 60 | 87 | 0.208 | 2.86 | 0.292 | A | |
| Ex. 7 | 40 | 60 | 220 | 60 | 88 | 0.209 | 3.43 | 0.350 | A | |
| Com. Ex. 1 | — | — | — | — | — | — | — | | — | Fail to wind |
| Com. Ex. 2 | 40 | 60 | 220 | 60 | 86 | 0.200 | 2.78 | 0.284 | A | |
| Com. Ex. 3 | 40 | 60 | 220 | 60 | 88 | 0.209 | 2.80 | 0.286 | A | |
| Com. Ex. 4 | — | — | — | — | — | — | — | — | — | Fail to spin |

The followings are found from the results in Table 1.

(1) In Comparative Example 1 without PMMA, it was impossible to produce a binder fiber having a small single fiber fineness of 0.8 dtex after spinning. On the other hand, in Example 1 with 1.0% PMMA, a binder fiber having a small single fiber fineness of 0.8 dtex was successively obtained.

(2) In Comparative Examples 2 and 3, both of which did not contain PMMA, it was possible to obtain binder fibers having single fiber finenesses of 1.0 dtex and 1.5 dtex, respectively. However, the papers with the binder fibers having single fiber finenesses of 1.0 dtex or 1.5 dtex had paper strengths of 2.78 kg/15 mm and 2.80 kg/15 mm, respectively. On the other hand, the fibers containing 1.0% PMMA (Examples 2 and 3) with single fiber finenesses of 1.0 dtex and 1.5 dtex had paper strengths of 3.43 kg/15 mm and 3.10 kg/15 mm, respectively. Accordingly, the reinforcement effects of these binder fibers on paper strength were successfully confirmed.

(3) In Comparative Example 4, it was impossible to obtain a binder fiber (1.5 dtex) where spinning was carried out from the polymer blend containing 7.0% PMMA.

(4) There is a tendency for binder fibers each containing 1.0% PMMA, as shown in Table 1, that the smaller single fiber fineness is (from 5.0 dtex in Example 4 to 0.8 dtex in Example 1), the higher paper strength is.

(5) The binder fiber containing 5.0% PMMA was slightly poor in spinnability, but had high paper strength (Example 5).

(6) The binder fiber containing only 0.1% PMMA contributed to paper strength of 2.86 kg/15 mm (Example 6), still higher than the paper strength in Comparative Example 3.

(7) In the binder fiber (Example 7) being a hollow fiber containing 1.0% PMMA, even if the single fiber fineness was large, the paper strength was similar to the paper strength in Example 2.

INDUSTRIAL APPLICABILITY

The polyester binder fiber according to the present invention is useful as a binder fiber of the fiber structure containing a drawn polyester fiber.

As mentioned above, the preferred embodiments of the present invention are illustrated, but one skilled in the art may make various changes or modifications, without departing from the spirit or scope of the present invention. Therefore, it is to be understood that such changes or modifications may be interpreted to fall within the spirit or scope of the present invention determined from claims.

What is claimed is:

1. A polyester binder fiber comprising:

a polyester; and a polymer having a repeating unit represented by the following formula (1) in a proportion of 0.1 to 5.0 mass % based on the mass of the polyester, the polyester binder fiber having a crystallization temperature measured by differential calorimetry in a range of 100° C. or higher and 250° C. or lower, wherein the polyester binder fiber is an undrawn fiber, has a fiber length of 0.5 to 50 mm, and has a single fiber fineness of 0.01 to 5.0 dtex, (1)

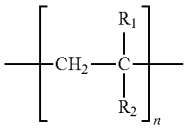

wherein $R_1$ and $R_2$ are substituents each comprising arbitrary atoms chosen from C, H, N, O, S, P, and a halogen atom, the sum of the molecular weights of $R_1$ and $R_2$ is 40 or more, and n is a positive integer.

2. The polyester binder fiber as claimed in claim 1, wherein the polymer having a repeating unit represented by the formula (1) is a polymethyl methacrylate.

3. The polyester binder fiber as claimed in claim 1, wherein the polyester comprises a polyethylene terephthalate.

4. The polyester binder fiber as claimed in claim 1, wherein the polyester has an intrinsic viscosity of 0.4 to 1.1 dL/g.

5. The polyester binder fiber as claimed in claim 1, wherein the polyester binder fiber has a single fiber fineness of 0.01 to 1.0 dtex.

6. The polyester binder fiber as claimed in claim 1, wherein the polyester binder fiber has a fiber cross-sectional shape of circular, modified, hollow, or conjugated.

7. A fiber structure comprising:

the polyester binder fibers as recited in claim 1, and polyester subject fibers each of which does not show a crystallization temperature, the polyester subject fibers being bonded via the polyester binder fibers.

8. The fiber structure as claimed in claim 7, wherein the fiber structure is a nonwoven fabric.

9. The fiber structure as claimed in claim 8, wherein the nonwoven fabric is a wetlaid nonwoven fabric.

10. The fiber structure as claimed in claim 9, wherein the wetlaid nonwoven fabric is a paper.

11. The polyester binder fiber as claimed in claim 1, wherein the polyester binder fiber has a fiber length of 1 to 25 mm.

12. The polyester binder fiber as claimed in claim 1, wherein the polyester binder fiber has a fiber length of 2 to 15 mm.

* * * * *